US006363534B1

(12) United States Patent
Clough

(10) Patent No.: US 6,363,534 B1
(45) Date of Patent: Apr. 2, 2002

(54) MITTENS WHICH PROVIDE EXTRA COMFORT AND PROTECTION FOR CHILDREN PLAYING IN THE SNOW

(76) Inventor: Timothy F. Clough, 12 Harding Ave., Bradford, MA (US) 01835

( * ) Notice: Subject to any disclaimer, the term of this patent is extended or adjusted under 35 U.S.C. 154(b) by 0 days.

(21) Appl. No.: 09/697,267

(22) Filed: Oct. 26, 2000

(51) Int. Cl.[7] ..... A41D 25/00
(52) U.S. Cl. ..... 2/158; 2/59
(58) Field of Search ..... 2/162, 164, 170, 2/161.1, 158, 159, 161.3, 160, 161.8, 59

(56) References Cited

U.S. PATENT DOCUMENTS 1,941,508 A * 1/1934 Zwicker ..... 2/158
2,778,027 A * 1/1957 Bacon ..... 2/158
4,195,405 A * 4/1980 Monk ..... 2/158
4,856,112 A * 8/1989 Effle ..... 2/59
5,361,415 A * 11/1994 Deering et al. ..... 2/158
5,864,886 A * 2/1999 Gregory et al. ..... 2/170

* cited by examiner

*Primary Examiner*—John J. Calvert
*Assistant Examiner*—Katherine Moran
(74) *Attorney, Agent, or Firm*—Robert Nathans

(57) ABSTRACT

An article of clothing for preventing snow from getting between a young child's mitten and overcoat sleeve and thus contacting the wrists and forearms of a young child playing in the snow, resulting in early termination of play, consisting of a pair of mittens, each having an elongated elastic snow shielding sleeve attached to each mitten and having a length at least as long as a major portion of a forearm of the young child.

15 Claims, 1 Drawing Sheet

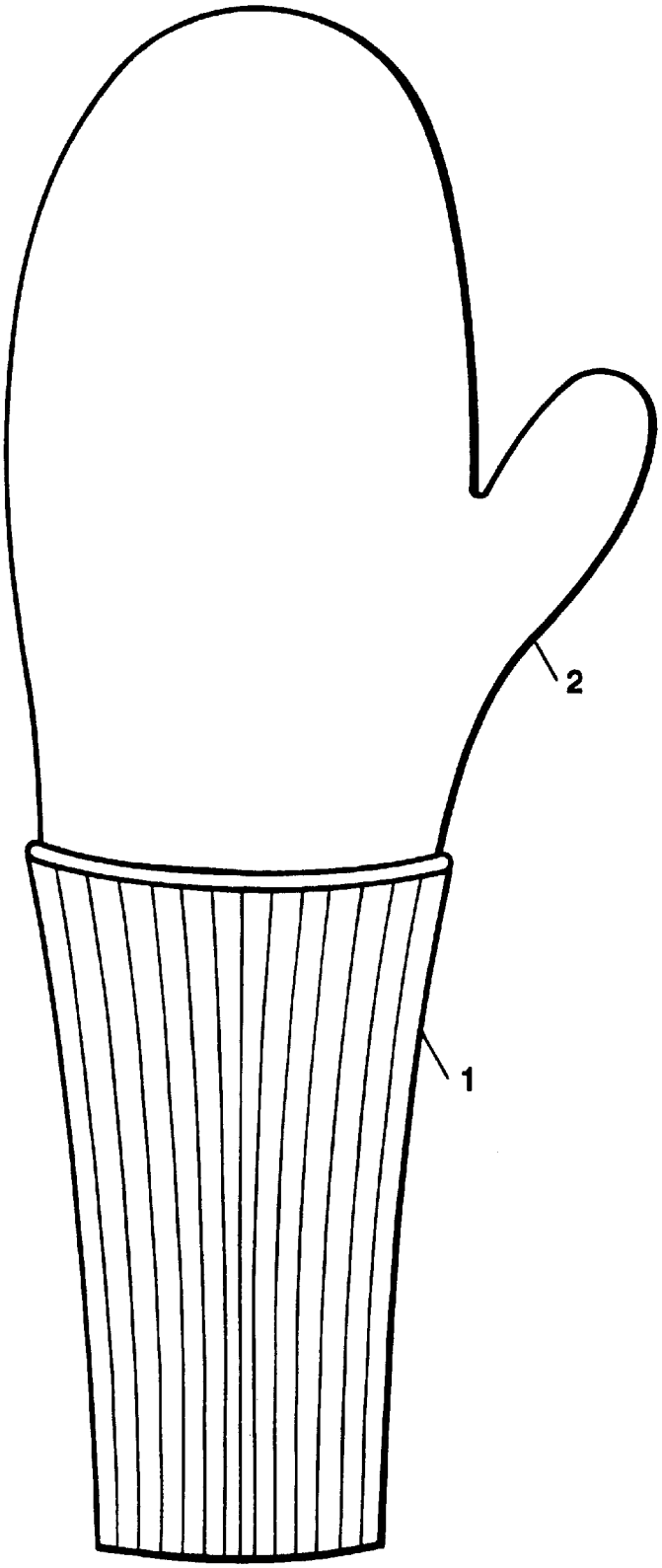
2
1

MITTENS WHICH PROVIDE EXTRA COMFORT AND PROTECTION FOR CHILDREN PLAYING IN THE SNOW

BACKGROUND OF THE INVENTION

The present invention relates to the field of articles of clothing, and more particularly to mittens for young children playing in the snow.

It is desirable to solve the age-old problem of snow getting in between the mitten and outer coat sleeves of young children, rendering the forearm unpleasantly cold and hence motivating the child to return to the indoors instead of having fun playing outdoors on a winters day. It is also desirable at the same time to prevent the mittens from falling off during play, which may result in loss of the mittens or exposing the child's hands to the cold.

The closest prior art directed to this problem that was found during our patent office database search was a patent issued to Deering et al., U.S. Pat. No 5,361,415. This patent discloses an elongated insulating shell member that is sewed to a child's mitten at one end thereof and that is held in place by an elastic band, attached to the elongated shell member at the opposite end of the insulating shell member, and gripping an arm portion of the child above the elbow. A stated object of the Deering invention is to deter the entrance of snow between the child's forearm and the sleeve of the child's coat, and additionally, to prevent the mitten from falling off during play. However, Deering's elongated tubular sleeve is passed over the sleeve of the child's outer coat until the elastic band grips the child's arm above the elbow and his/her hand is fitted within the mitten. This results in a somewhat clumsy and bulky arrangement that tends to make the young toddler more uncomfortable. Young kids can be very cranky when uncomfortable. Also, fitting the Deering tubular sleeve over the sleeve of the overcoat can be tedious, annoying and time consuming.

SUMMARY OF A PREFERRED EMBODIMENT OF THE INVENTION

In accordance with the present invention, a thin elongated snow shield sleeve, preferably of an elasticized fabric, is attached as an integral part of the child's mitten. This snow shield sleeve extends up to the elbow region of the child's arm once the child's hand and forearm are passed through the sleeve and into the mitten. Once suited up with an overcoat, the sleeve of the child's overcoat thereafter covers the thin elongated elasticized sleeve and the relatively bulky sleeve of the aforesaid prior art, fitted over the overcoat, is eliminated to contribute to the comfort of the child. With this arrangement the snow may not be completely blocked from entering the space between the inside of the child's outer coat sleeve and the child's wrist and forearm area, but the elasticized fabric attached to the mittens effectively shields the skin of the wrist and forearm from the cold snow. Also, the present invention lowers manufacturing costs as will be explained.

BRIEF SUMMARY OF THE DRAWING

The invention will be further detailed in the following description taken in conjunction with the sole FIGURE, illustrating a preferred embodiment of the invention.

DETAILED DESCRIPTION OF PREFERRED EMBODIMENTS OF THE INVENTION

As shown in the sole FIGURE, an elongated elasticized snow shield sleeve 1 is attached, preferably by sewing, to a child's mitten 2, which sleeve is preferably sufficiently elongated to extend to the neighborhood of the child's elbow, after the hand and forearm of the child are passed through the elasticized sleeve 1 and h/her hand is fitted into the mitten. When the toddler is fully dressed, the sleeves of the overcoat thereafter cover the elongated elasticized sleeves worn over the left and right forearms of the child, when her hands are within the mittens.

Thus the "SnowStoppers" mittens solve the age-old problem of snow getting in between the coat and the mittens and contacting the child's skin, spoiling the fun of playing in the snow. However, in contrast with the Deering et al. prior patent, this problem is solved without the use of Deering's outer tubular sleeve that is positioned over the overcoat sleeve which makes the child more uncomfortable due to the bulk of the outer tubular sleeve combined with the underlying coat sleeve. Also, the pushing of the prior art outer tubular sleeve over the outer overcoat sleeve when dressing the child, can be annoying and tedious for the parent. This annoyance is due to substantial frictional resistance between the outer surface of the child's overcoat and the inside surface of the prior art outer tubular sleeve while pushing it over the outer coat sleeve while suiting up the child. This undesired frictional resistance is like fitting a second pair of thick wool socks over a first pair already on a person's foot. Hence, the presence of the relative thin elasticized fabric of the inner sleeve of the present invention under the overcoat sleeve results in more comfort for the child due to reduced bulk and at the same time makes it easier for the parent to dress the child.

An additional benefit of the invention is to eliminate the need to provide the aforesaid separate elasticized band of the aforesaid Deering et al., patent, which elastic band holds their outer tubular sleeve to the child's upper arm. This is enabled by the use of the elasticized sleeve of the present invention, which employs an elasticized fabric for providing a more gentle and uniform gripping action over the entire forearm area, to maintains the position of the elasticized sleeve on the forearm without the need for the additional elastic band. Accordingly, manufacturing costs are reduced as the elastic band need not be provided. The additional cost of attaching the elastic bands to the ends of the tubular outer sleeves of the prior art are also eliminated. The elasticized sleeve 1 also prevents the mitten from falling off during play.

The recently marketed "SnowStoppers" mittens of the present invention employed 100% stretch "Nylon" elastic fabric for the sleeves 2, and 100% polyester for the mittens 1. The currently most preferred snow shielding sleeve material is a tubular rib knit fabric. For most sizes the sleeve lengths are about equal to the lengths of the mittens as shown in the figure.

As variations on the foregoing will be apparent to the workers in the art, the scope of the invention is to be limited only in accordance with the terms of the following claims and art recognized equivalents thereof. The term "elastic snow shielding sleeve" is intended to cover clothing materials that stretch when applied to the body and tend to reassume their original shape when no longer worn, such as the material set forth in the preceding paragraph. The material used in widely available "stretch socks" is an additional example. The term "young child" is intended to include toddlers or kids up to the age of about ten.

What is claimed is:

1. A method of preventing snow from contacting the wrists and forearms of a young child playing in the snow, which may result in termination of play, comprising the steps of:

(a) providing a pair of mittens, each having an elongated snow shielding sleeve attached to each mitten, said elongated snow shielding sleeve being thin enough to permit an overcoat sleeve to be readily slipped over said elongated snow shielding sleeve, said elongated snow shielding sleeve having a length extending up to the elbow region of said young child;

(b) passing the child's hands and forearms through each elongated snow shielding sleeve until each mitten covers each hand and each elongated snow shielding sleeve covers a substantial major portion of a forearm of said young child, extending up to but not over the elbow region of said young child; and (c) thereafter continuing to dress the child for playing in the snow by passing the child's hands and forearms through a pair of overcoat sleeves.

2. The method of claim 1 wherein step (c) involves causing each overcoat sleeve of said pair of overcoat sleeves to cover a substantial portion of each elongated snow shielding sleeve.

3. A method preventing snow from contacting the wrists and forearms of a young child playing in the snow, which may result in early termination of play, comprising the steps of:

(a) providing a pair of mittens, each mitten having an elongated snow shielding elastic sleeve attached to each mitten, said elastic snow shielding sleeve being thin enough to permit an overcoat sleeve to be readily passed over said snow shielding elastic sleeve;

(b) passing the child's hands and forearms through each elongated snow shielding elastic sleeve until each mitten covers each hand and each elongated snow shielding sleeve covers almost all of the forearm of the young child up to a forearm portion under and in the neighborhood of an elbow of the child; and (c) thereafter continuing to dress the child for playing in the snow by passing the child's hands and forearms through a pair of overcoat sleeves.

4. The method of claim 3 wherein step (c) involves causing each overcoat sleeve of said pair of overcoat sleeves to cover a substantial portion of each elongated snow shielding sleeve.

5. An article of clothing for preventing snow from contacting the wrists and forearms of a young child playing in the snow, resulting in early termination of play, comprising:

a pair of mittens, each having an elongated snow shielding sleeve attached to each mitten of said pair of mittens, wherein each elongated snow shielding sleeve has a length extending up to an elbow region of said young child and wherein each elongated snow shielding sleeve is thin enough to permit an overcoat sleeve to be easily slipped over each elongated snow shielding sleeve.

6. The article of clothing of claim 5 wherein each elongated snow shielding sleeve emends up to but not over said elbow region and is made of a material that stretches when applied to said wrists and forearms.

7. The article of clothing of claim 6 wherein each elongated snow shielding sleeve is permanently attached to an associated mitten and said material is made of an elastic stretch fabric.

8. The article of clothing of claim 5 wherein each elongated snow shielding sleeve has a length about equal to the length of each mitten.

9. The article of clothing of claim 6 wherein each elongated snow shielding sleeve has a length about equal to the length of each mitten.

10. The article of clothing of claim 7 wherein each elongated snow shielding sleeve has a length about equal to the length of each mitten.

11. The article of clothing of claim 6 wherein each elongated snow shielding sleeve comprises an elastic rib knit fabric.

12. The article of clothing of claim 7 wherein each elongated snow shielding sleeve comprises an elastic rib knit fabric.

13. The article of clothing of claim 8 wherein each elongated snow shielding sleeve comprises an elastic rib knit fabric.

14. The article of clothing of claim 9 wherein each elongated snow shielding sleeve comprises an elastic rib knit fabric.

15. The article of clothing of claim 10 wherein each elongated snow shielding sleeve comprises an elastic rib knit fabric.

* * * * *